US005533567A

United States Patent [19]

Van Putten et al.

[11] Patent Number: 5,533,567

[45] Date of Patent: Jul. 9, 1996

[54] METHOD AND APPARATUS FOR UNIFORM HEATING AND COOLING

[75] Inventors: Maurice H. P. M. Van Putten, Ithaca, N.Y.; Andrew G. Felce, London, England

[73] Assignee: The Regents of The University of California, Oakland, Calif.

[21] Appl. No.: 356,447

[22] Filed: Dec. 14, 1994

[51] Int. Cl.[6] ..... F28F 13/06

[52] U.S. Cl. ..... 165/1; 165/104.28; 165/109.1; 165/DIG. 318

[58] Field of Search ..... 165/1, 104.23, 165/104.28, 109.1; 417/50; 310/11

[56] References Cited

U.S. PATENT DOCUMENTS

| | | | |
|---|---|---|---|
| 3,574,485 | 4/1971 | Herman, Jr. . | |
| 3,654,528 | 4/1972 | Barkan | 165/104.28 X |
| 3,740,593 | 6/1973 | Zar . | |
| 3,757,846 | 9/1973 | Herman, Jr. . | |
| 4,161,436 | 7/1979 | Gould . | |
| 4,355,262 | 10/1982 | Chan et al. . | |
| 4,396,055 | 8/1983 | Mitchell, Jr. | 165/1 |
| 4,515,206 | 5/1985 | Carr | 165/1 |
| 4,519,447 | 5/1985 | Weich, Jr. | 165/104.33 |
| 4,767,953 | 8/1988 | Furuya et al. . | |
| 4,802,531 | 2/1989 | Nathenson et al. | 165/104.28 |
| 5,176,203 | 1/1993 | Larzul | 165/61 |
| 5,231,834 | 8/1993 | Burnett . | |

FOREIGN PATENT DOCUMENTS

| | | | |
|---|---|---|---|
| 59-131884 | 7/1984 | Japan | 165/104.23 |

*Primary Examiner*—Allen J. Flanigan
*Attorney, Agent, or Firm*—John P. O'Banion

[57] ABSTRACT

A method and apparatus for producing uniform heating and cooling using an electrically and, thermally conductive liquid or ionized gas as a heat transfer medium. The fluid is enclosed within a chamber defined by a top plate, a bottom plate, and a surrounding rim. Azimuthal motion is imparted to the fluid by passing a current between an electrode which is centrally positioned in the bottom plate and a continuous ring electrode which is positioned circumferentially around the bottom plate. Rolling motion, which causes the fluid to shear over the top and bottom plates, is imparted to the fluid by sequentially passing a current between a plurality of opposing electrode pairs positioned circumferentially around the upper plate in the presence of an axially aligned magnetic field produced by a magnet positioned beneath the lower plate. The positions of the continuous ring electrode and the opposing electrodes pairs can be interchanged to increase Lorentz forces by passing the current between the opposing electrode pairs where the magnetic field is greatest. In addition, the continuous ring electrode can be eliminated if desired and, instead, the opposing electrode pairs operated in a mode which electrically simulates the continuous ring electrode or in a mode which energizes the opposing electrode pairs at an elevated potential in relation to the center electrode. The lower plate includes a heating or cooling element for transferring heat between the lower plate and the fluid. As a result of the motion produced, uniform heat transfer between the upper plate and the fluid occurs.

54 Claims, 5 Drawing Sheets

METHOD AND APPARATUS FOR UNIFORM HEATING AND COOLING

GOVERNMENT SUPPORT

The Government has rights in this invention pursuant to Grant No. PHY-8904035 awarded by the National Science Foundation.

BACKGROUND OF THE INVENTION

1. Field of the Invention

This invention pertains generally to devices for heating or cooling objects, and more particularly to a method and apparatus for uniformly heating or cooling a plate using an electrically and thermally conducting fluid subjected to azimuthal and rolling motion beneath the plate.

2. Description of the Background Art

Heating or cooling of a plate for the purpose of controlled experiments has wide application in science and technology. Known devices for such use generally comprise two elements: a heating or cooling element, and a plate. Usually, the heating or cooling element resides inside the plate for effective heat transfer and, in an attempt to achieve uniform heating for example, electrical heating wires are distributed evenly over the plate and the plate is made of a material of high thermal conductivity. However, such devices are limited in the achievable uniformity of their temperature by limitations in the uniformity with which the wires are distributed and give off heat, and by finite heat conductivity of the plate. Similar problems are encountered in the process of cooling. Therefore, a need exists for a method and apparatus for uniformly heating or cooling a plate. The present invention satisfies that need, as well as others, and overcomes the deficiencies found in known devices.

SUMMARY OF THE INVENTION

The present invention generally pertains to an apparatus for heating or cooling a plate with a high degree of uniformity in temperature distribution through the agency of internal convection of an internal fluid, said convection being powered by electric current. The fluid is electrically and thermally conductive, and can be either a liquid, such as Mercury, or an ionized gas, such as Neon.

By way of example, and not of limitation, an apparatus in accordance with the present invention includes spaced apart upper and lower plates which are held together by an outer rim, thereby forming an enclosed chamber which is filled with the electrically and thermally conductive fluid. The lower plate includes a heating or cooling element for transferring heat between the lower plate and the fluid. The two plates are generally parallel, and are aligned along a central axis, or z-axis, extending between the two plates in a generally perpendicular orientation. A disk-shaped center electrode is axially aligned with the z-axis and positioned adjacent to the lower plate so that the lower plate extends circumferentially around the center electrode. A continuous ring electrode, also aligned with the z-axis, is positioned circumferentially around the lower plate in a ring-shaped configuration and is substantially coplanar therewith. A plurality of paired, opposing, segmented ring electrodes are positioned circumferentially around the upper plate in a ring-shaped configuration and are substantially coplanar therewith. A magnet is positioned beneath the lower plate to produce a magnetic field inside the chamber which is axially aligned with the z-axis.

When an electric current is applied to the electrodes, the fluid is forced into convection through both rolling motion and azimuthal motion. The rolling motion is about a rolling axis of symmetry which is perpendicular to the z-axis; that is, the rolling axis is the x-axis in relation to the z-axis. The rolling motion of the fluid is generated by the electric current, supplied by an external power source, passing through the fluid between opposing segmented ring electrodes under the influence of the axially aligned magnetic field. With a large number of such pairs of opposing segmented ring electrodes, the rolling axis can be made to rotate about the z-axis by successively powering adjacent pairs of opposing electrodes with a switching control in the external power source. In particular, this results in opposite rolling motions after 180° rotation of the rolling axis about the z-axis. Thus, any linear gradient in temperature on the upper plate, along the direction of motion of the fluid shearing underneath, is compensated by the same linear temperature gradient, but of opposite sign, after rotation of the rolling axis over 180°. This compensation process effectively induces a uniform mean temperature in the upper plate, when rolling velocities are sufficiently high to establish linear temperature gradients. The azimuthal motion is about the z-axis. The azimuthal motion of the fluid is generated by radial currents, supplied by a second external power source, passing through the fluid between the center electrode and the ring electrode.

In accordance with a second embodiment of the invention, the continuous ring electrode is positioned circumferentially around the upper plate while the segmented ring electrodes are positioned circumferentially around the lower plate. This embodiment maximizes the generation of Lorentz forces induced by the segmented ring electrode because the segmented ring electrodes release their current close to the magnet where the magnetic field is the strongest.

In accordance with a third embodiment of the invention, the continuous ring electrode is eliminated but the segmented ring electrodes are operated in a manner which simulates the continuous ring electrode. In a first mode of operation, the paired opposing segmented ring electrodes are sequentially energized about the z-axis as described above to generate rolling motion. In a second mode of operation, all of the segmented ring electrodes are simultaneously energized in the switching control of the power supply and given a potential difference with respect to the center electrode. These two modes are switched between at a sufficiently high frequency that the motion of the fluid is essentially the same as with a separate continuous ring electrode. A single power supply is used in this embodiment in combination with switching controls.

In accordance with a fourth embodiment of the invention, the continuous ring electrode is again eliminated but the opposing segmented ring electrodes are rotated through at an elevated potential. Here, a controlled nonzero mean potential difference between the segmented ring electrodes and the center electrode is maintained. In this embodiment, a single power supply is used wherein the center electrode is constantly energized while the segmented ring electrodes are sequentially energized through a switching control in the power supply as before.

An object of the invention is to uniformly heat or cool a plate using forced internal convection of an electrically and thermally conductive fluid.

Another object of the invention is to provide for an apparatus for uniform heating or cooling of a plate with no moving mechanical components.

Another object of the invention is to provide an apparatus for uniformly heating or cooling a plate which is relatively flat and compact.

Further objects and advantages of the invention will be brought out in the following portions of the specification, wherein the detailed description is for the purpose of fully disclosing preferred embodiments of the invention without placing limitations thereon.

BRIEF DESCRIPTION OF THE DRAWINGS

The invention will be more fully understood by reference to the following drawings which are for illustrative purposes only.

DESCRIPTION OF THE PREFERRED EMBODIMENTS

Referring more specifically to the drawings, for illustrative purposes the present invention is embodied in the apparatus generally shown in FIG. 1 through FIG. 6. It will be appreciated that the apparatus may vary as to configuration and as to details of the parts without departing from the basic concepts as disclosed herein.

Figure 1:
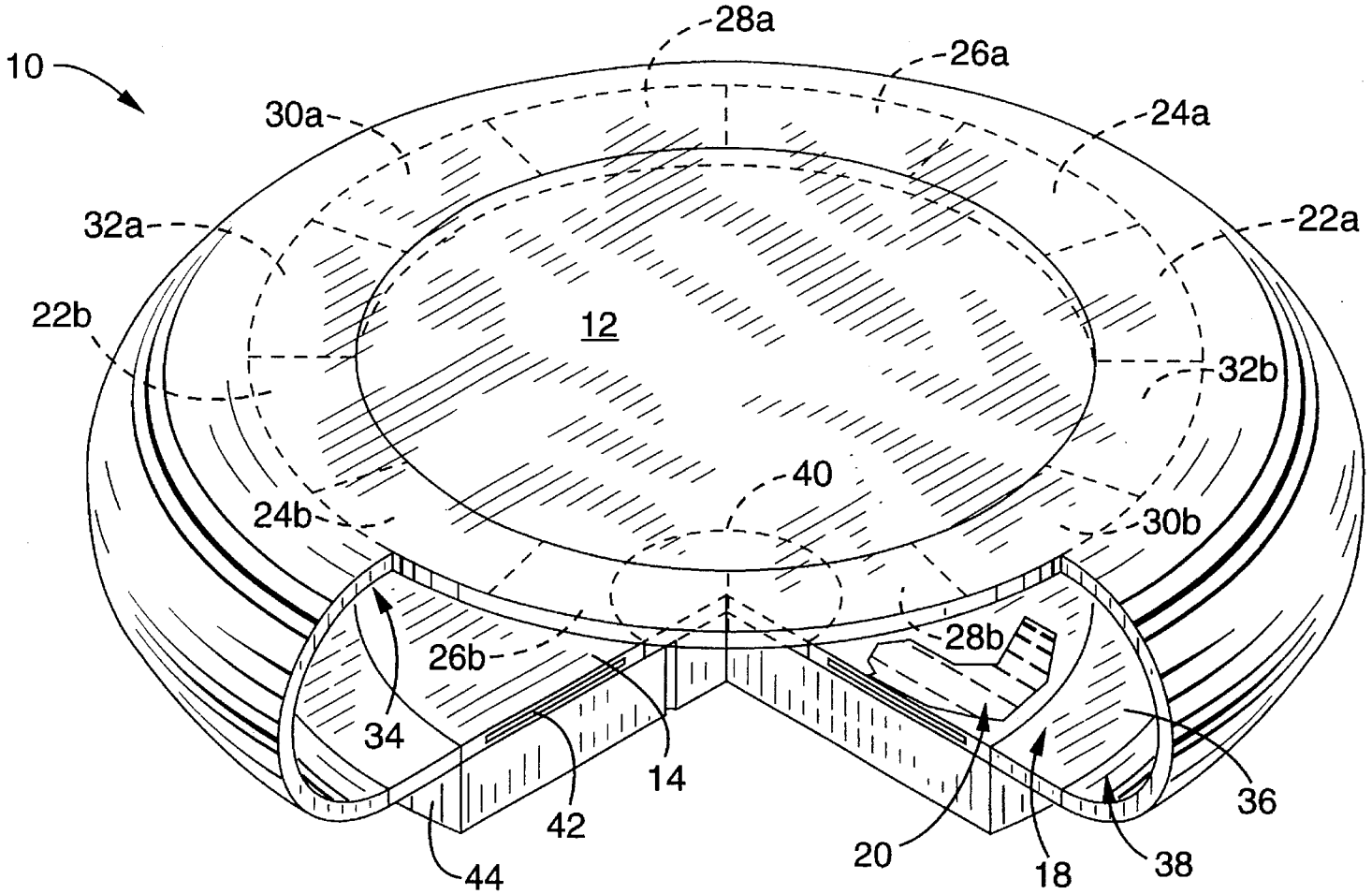
FIG. 1 is a perspective view of an apparatus in accordance with the present invention showing the rim, bottom plate, continuous ring electrode, center electrode and magnet in partial cutaway, and showing the ring electrodes in hidden lines.
Figure 2:
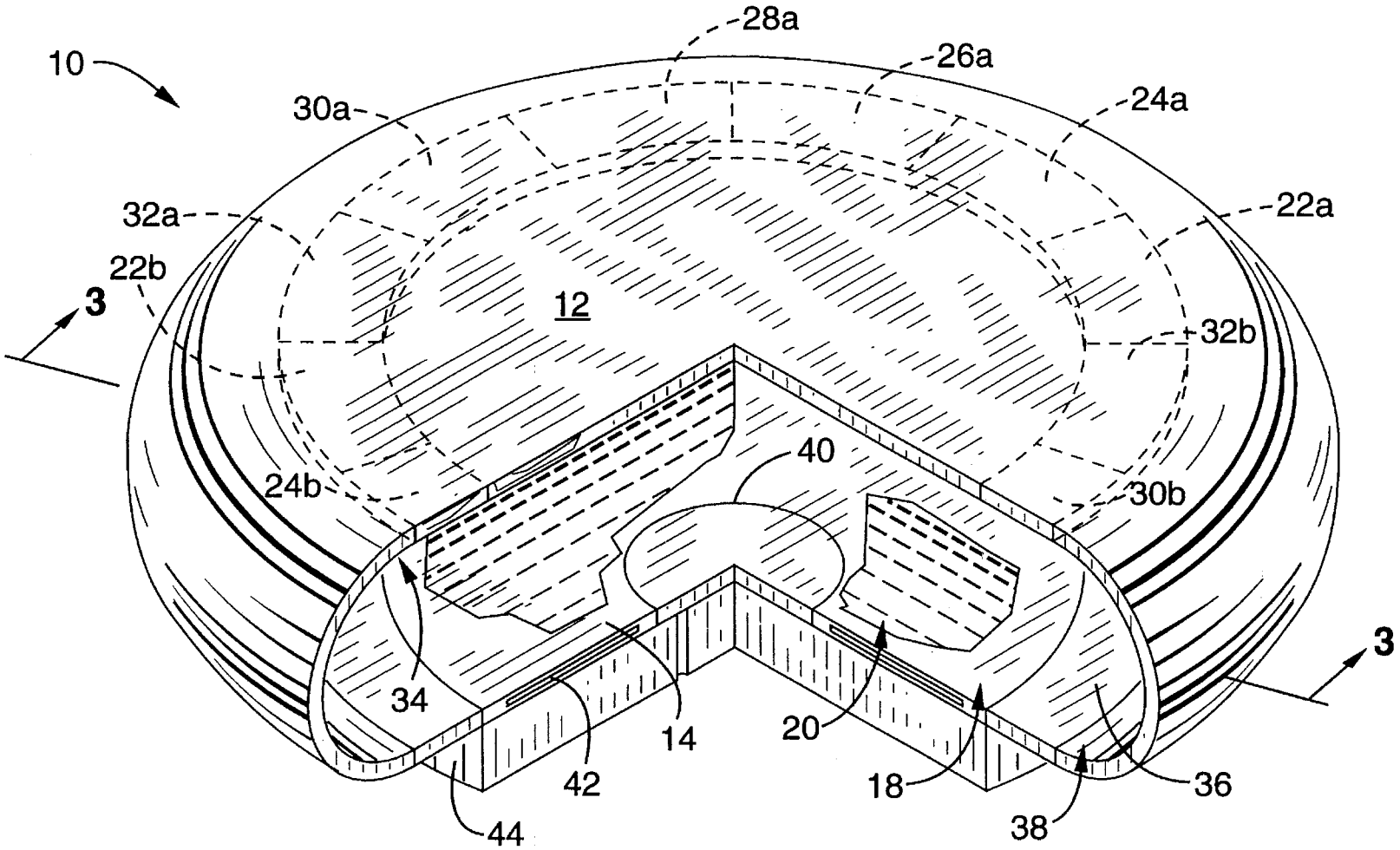
FIG. 2 is a perspective view of the apparatus shown in FIG. 1 with the segmented ring electrodes shown in partial cutaway and hidden lines.
Figure 3:
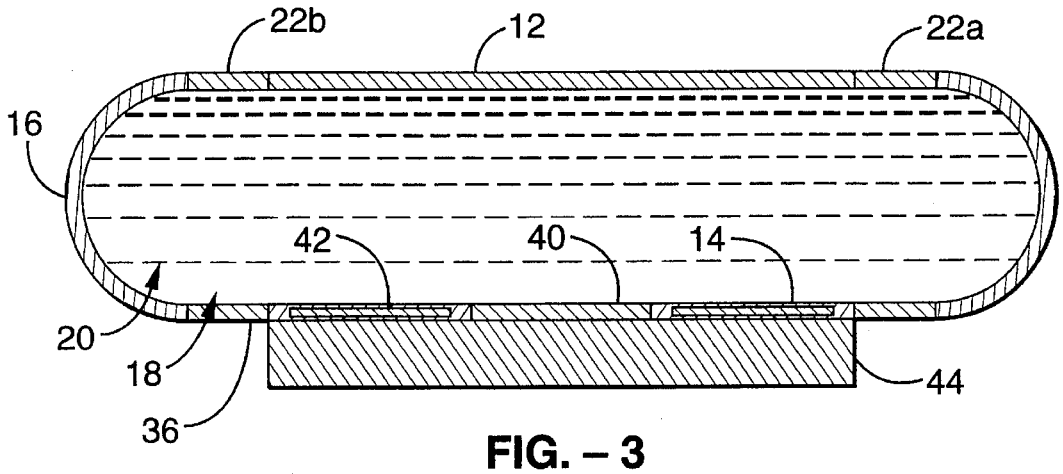
FIG. 3 is a cross-sectional view of the apparatus shown in FIG. 2 taken through line 3—3.

Referring to FIG. 1 through FIG. 3, a heating and cooling apparatus 10 in accordance with the present invention includes a generally planar upper plate 12, a generally planar lower plate 14, and a rim 16 extending circumferentially around upper plate 12 and lower plate 14. Upper plate 12 and lower plate 14 are spaced apart so that an enclosed chamber 18 is formed interior to upper plate 12, lower plate 14 and rim 16. Chamber 18 is filled with an electrically and thermally conductive fluid 20, which can be either a liquid, such as Mercury, or an ionized gas, such as Neon.

Upper plate 12 and lower plate 14 are fixed in a substantially parallel orientation in relation to each other, and are aligned along a central axis, or z-axis, which extends between, and is perpendicular to, the plates. Upper plate 12 and lower plate 14 are preferably fabricated from thermally conductive materials which are electrical insulators, such as glass or the like, and rim 16 is fabricated from a thermally insulating material. Note, however, that the thermal conductivity of upper plate 12 can be varied depending upon the quality of heat transfer desired as may be dictated by the heat transfer characteristics of the object which will be rested upon upper plate 12 and heated or cooled. It will also be appreciated that the upper plate, if coupled to a source of electric power and used as an electrode as described below, would be made electrically conductive on its inside surface.

A plurality of paired, opposing segmented ring electrodes 22*a–b*, 24*a–b*, 26*a–b*, 28*a–b*, 30*a–b*, and 32*a–b* extend circumferentially around upper plate 12 adjacent to the upper inside surface 34 of rim 16 in a ring-shaped configuration, and are substantially coplanar with upper plate 12. Each said segmented ring electrode is electrically insulated from each adjacent segmented ring electrode. A continuous ring electrode 36, also having a ring-shaped configuration, extends circumferentially around lower plate 14 adjacent to the lower inside surface 38 of rim 16. While it is preferred that continuous ring electrode 36 be coplanar with lower plate 14 so as not to interfere with the movement of fluid 20 inside chamber 18, continuous ring electrode 36 could extend into chamber 18 if desired. Also provided is a disk-shaped center electrode 40 which is positioned in the center of lower plate 14. As can be seen, lower plate 14 is also ring-shaped and extends circumferentially around center electrode 40 which is substantially coplanar with lower plate 14.

In the preferred embodiment, lower plate 14 includes a heat transfer element 42 for transferring heat between lower plate 14 and fluid 20. Heat transfer element 42 cart be any conventional heating or cooling device. For example, resistive heating elements or solid state junction devices could be used for heating, while solid state junction devices or circulating liquids could be used for cooling. Alternatively, heat transfer element 42 could be a separate heating or cooling device which is positioned external to the apparatus immediately adjacent to and contacting lower plate 14.

Figure 4:
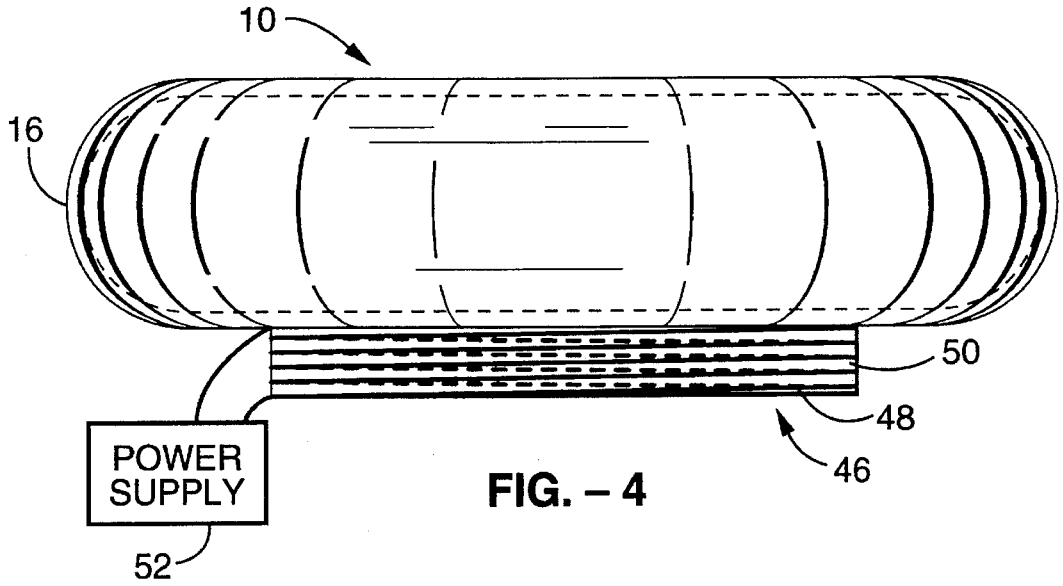
FIG. 4 is a side elevation view of an alternative embodiment of the apparatus shown in FIG. 1 employing an electro-magnet.

The apparatus also includes means for inducing a magnetic field in chamber 18 which is axially aligned with the central axis extending between upper plate 12 and lower plate 14. In the preferred embodiment, a permanent magnet 44 is positioned external to chamber 18 and adjacent to lower plate 14. Alternatively, an electro-magnet 46 comprising a coil 48 wound around a core 50 and electrically coupled to a power supply 52 could be employed as shown in FIG. 4. In the event that an external heat transfer element 42 is employed, heat transfer element 42 would be positioned between lower plate 14 and either magnet 44 or electro-magnet 46. Note also that, where heat transfer element 42 comprises an electric heating element, heat transfer element 42 may be configured by winding electrically resistive wires concentrically about the central axis. In this event, the current through the electric heating element will also produce an axial magnetic field, which can be enhanced by using magnet 44 or electro-magnet 46.

As can be seen, therefore, upper plate 12, lower plate 14, segmented ring electrodes 22*a* through 32*b*, continuous ring electrode 36, center electrode 40, and magnet 44 or electro-magnet 46 are all axially aligned in relation to the central axis (z-axis). Further, upper plate 12 and segmented ring electrodes 22*a* through 32*b* join to form an upper wall of chamber 18 while ring electrode 26, lower plate 14, and center electrode 40 join to form a lower wall of chamber 14. Also, each of the electrodes is preferably fabricated from a noncorrosive material capable of sustaining contact with fluid 20 without degradation.

Figure 5:
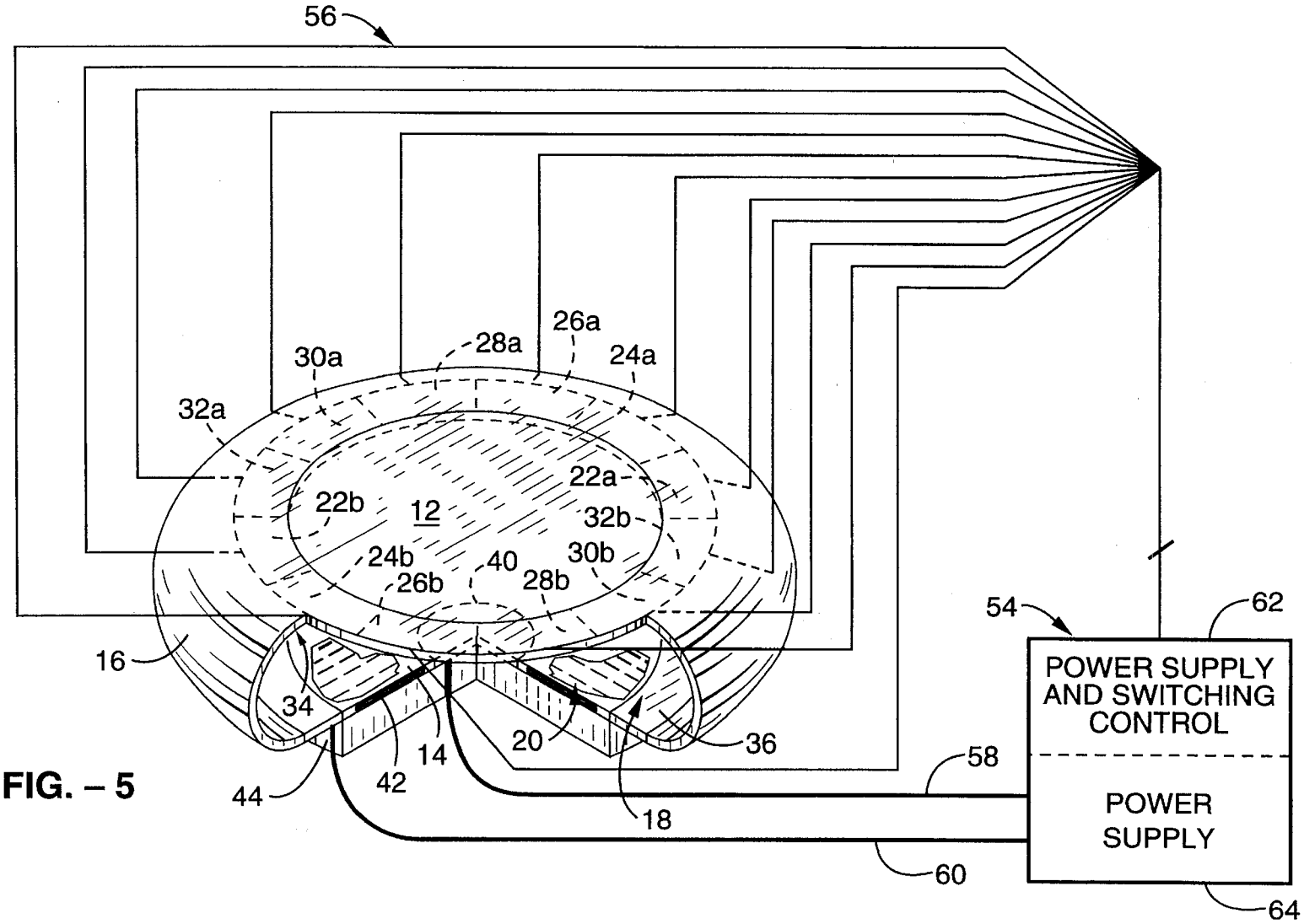
FIG. 5 is a schematic diagram showing the apparatus of FIG. 1 electrically connected to a source of electric current.

Referring now to FIG. 5, segmented ring electrodes 22*a* through 32*b* are electrically coupled to a power supply 54 through a plurality of interconnecting wires 56, center electrode 40 is electrically coupled to power supply 54 through interconnecting wire 58, and continuous ring electrode 36 is electrically coupled to power supply 54 through interconnecting wire 60. In the preferred embodiment, power supply 54 comprises a first isolated power source 62 and a second isolated power source 64. First power source 62 provides electrical current to the segmented ring electrodes, while second power source 64 provides electrical current to continuous ring electrode 36 and center electrode 40. Application of electric current to these electrodes forces fluid 20 into convection through both rolling motion and azimuthal motion produced by the agency of Lorentz forces induced by the electrodes. As a result, a uniform temperature transfer is effected between upper plate 12 and fluid 20.

The rolling motion, which is motion of fluid 20 about a rolling axis of symmetry (x-axis) which is perpendicular to the central axis (z-axis), is generated by the electric current passing between opposing pairs of the segmented ring electrodes under the influence of the magnetic field produced by magnet 44 or electromagnet 46 and axially aligned with the central axis. In this regard, note that it is preferable that the opposing segmented ring electrodes be spaced apart as widely as possible in chamber 18 so that the electric current will pass between the electrodes through a large gap, so as to maximize the amount of fluid 20 subjected to rolling motion. Note also, that only one pair of the opposing segmented ring electrodes is energized at time. For example, segmented ring electrodes 22*a*, 22*b* would be first energized from power supply 54. A switching circuit in power supply 54 would then de-energize segmented ring electrodes 22*a*, 22*b* and energize segmented ring electrodes 24*a*, 24*b*. Note that with a large number of such pairs of segmented ring electrodes circumferentially disposed around upper plate 12 as shown, the rolling axis can be set into rotation about the central axis by this successive energization of adjacent pairs of opposing segmented ring electrodes. In particular, this results in opposite rolling motions after 180° rotation of the rolling axis. Thus, any linear gradient in temperature on the upper plate 12, along the direction of motion of the fluid shearing underneath, is compensated by the same linear temperature gradient, but of opposite sign, that is, after rotation of the rolling axis over 180°. This compensation process effectively induces a uniform mean temperature in the upper plate 12, when rolling velocities are sufficiently high to establish linear temperature gradients.

The azimuthal motion, which is motion of fluid 20 about the central axis (z-axis), is generated by the electric current passing between center electrode 40 and continuous ring electrode 36. In this regard, note that it is desirable that center electrode 40 be of a small diameter in relation to that of continuous ring electrode 36 so that the current will pass radially between the electrodes through a large gap, thereby maximizing the amount of fluid 20 subjected to azimuthal motion.

While it is preferred to use a power supply 54 having first 62 and second 64 isolated sources of power, those skilled in the art will appreciate that a single source of power could also be utilized. Note, however, that use of a single source of power to energize the electrodes could result in electric current flowing between electrodes through undesired paths. Therefore, where a single power source is used, power supply 54 would include circuitry to switch between energizing the segmented ring electrodes, and between the ring and center electrodes, in an alternating manner. In this way, the segmented ring electrodes would not be energized at the same time as the ring and center electrodes. Note also, that continuous ring electrode 36 could be eliminated and, instead, upper plate 12 could be configured as an electrode by making its inner surface electrically conductive. In that event, it would be necessary to electrically isolate upper plate 12 and the segmented ring electrodes and, further, provide circuitry to alternate between energizing the segmented ring electrodes, and energizing the path between the center electrode and upper plate electrode.

It will be appreciated that the embodiment of FIG. 1 through FIG. 5 could be modified to increase the Lorentz forces induced by the electrodes by interchanging the positions of the segmented ring electrodes and the continuous ring electrode. In such an embodiment, continuous ring electrode 36 would be positioned circumferentially around, and coplanar with, upper plate 12 while the segmented ring electrodes 22*a* through 32*b* would be positioned circumferentially around, and coplanar with, lower plate 14. This embodiment maximizes the generation of Lorentz forces because the segmented ring electrodes release their current close to the magnet 44 where the magnetic field is the strongest.

Figure 6:
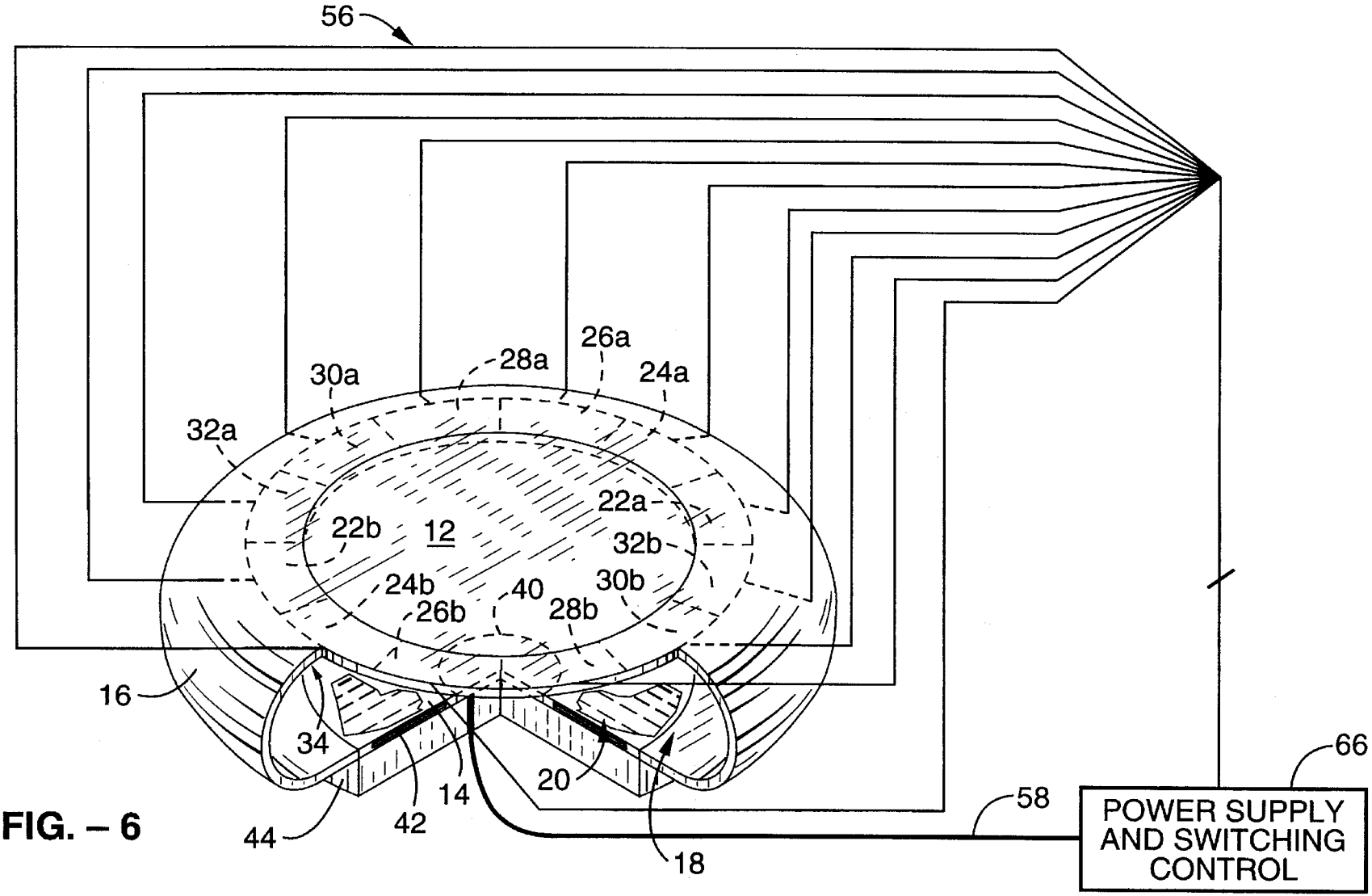
FIG. 6 is a schematic diagram showing an alternative embodiment of the apparatus of FIG. 1 electrically connected to a source of electric current.

Referring now to FIG. 6, an alternative embodiment of the present invention is shown wherein continuous ring electrode 36 has been eliminated. In this embodiment, the segmented ring electrodes 22*a* through 32*b* are operated in a manner which simulates continuous ring electrode 36. This is accomplished by switching between two modes of energization of segmented ring electrodes 22*a* through 32*b*. In the first mode of operation, the paired opposing segmented ring electrodes are sequentially energized about the z-axis as described above to generate rolling motion. In the second mode of operation, all of the segmented ring electrodes are simultaneously energized and given a potential difference with respect to center electrode 40. These two modes are switched between at a sufficiently high frequency that the motion of the fluid 20 is essentially the same as for the embodiment of FIG. 1 through FIG. 5. A combination power supply and switching control 66 is used to provide the electrode energization and mode switching described, with center electrode 40 being electrically coupled thereof through interconnecting wire 58 and segmented ring electrodes 22*a* through 32*b* being electrically coupled thereto through the plurality of interconnecting wires 56. For example, segmented ring electrodes 22*a*, 22*b* would be first energized from power supply and switching control 66. Next, segmented ring electrodes 22*a*, 22*b* would be de-energized. Then all of the segmented ring electrodes would be energized simultaneously as would center electrode 40. Next, the segmented ring electrodes and center electrode 40 would be de-energized, and segmented ring electrodes 24*a*, 24*b* would be energized.

Still referring to FIG. 6, instead of switching between the two modes of operation as described above to effect azimuthal and rolling motion, it is also possible to effect such motion by rotating through segmented ring electrodes 22*a* through 32*b* at an elevated potential in relation to center electrode 40. In other words, $V_1-V_2\neq 0$ where $V_1$ is the mean voltage applied to the segmented ring electrodes and $V_2$ is the voltage applied to the center electrode. Here, center electrode 40 would be constantly energized, while segmented ring electrodes 22*a* through 32*b* would be sequentially energized as before. In this regard, note that the nonzero mean potential difference between the segmented ring electrodes and the center electrode will not interfere with sequentially energizing opposing pairs of segmented ring electrodes.

It will be appreciated that, while the embodiment of FIG. 6 shows the segmented ring electrodes 22*a* through 32*b* positioned circumferentially around, and coplanar with, upper plate 12, those electrodes could alternatively be positioned circumferentially around, and coplanar with, lower plate 14. As described previously, this positioning of the segmented ring electrodes maximizes the Lorentz forces induced because the magnetic field is the strongest in this region. Moreover, this positioning of the segmented ring electrodes will serve to keep nonuniform effects due to internal electric heating away from upper plate 12, and effectively confine undesired heating effects to the region around lower plate 14.

Accordingly, it will be seen that this invention provides for greater uniformity of heating than possible with existing devices. It will be appreciated that fluid 20 will convect from one plate to the other via flow reversal inside the rim 16. A shear flow remains in between upper plate 12 and lower plate 14, because the flow reversal takes place away from either plate. The device according to the invention has no moving mechanical parts, can be fabricated at a low cost, and can be configured in the same dimensions as many existing devices and in relatively flat size. Thus, the device can serve to replace existing devices where uniformity in temperature is critical.

As can be seen, the present invention provides for uniform heating or cooling of a plate wherein heat transfer between the plate and a heating or cooling source is mediated through an electrically conductive fluid such that homogeneous heat transfer, in the sense of minimizing the time-average of the temperature gradients that may arise in the plate, is achieved by forced convection of the fluid using Lorentz forces induced by the electrodes. The forced convection generally comprises the combination of azimuthal motion associated with a rotational orientation of the fluid generally perpendicular to the plate, rolling motion associated with a rotational orientation of the fluid generally parallel to the plate, and rotation of the rotational orientation associated with the rolling motion over all angles with respect to an axis generally perpendicular to the plate. The Lorentz forces for the forced convection are achieved by passing electric currents between electrodes in the presence of a magnetic field which is generally perpendicular to the plate. The azimuthal motion is obtained by electric currents flowing between a small electrode concentric and close to the plate and a larger ring electrode concentric and near the edge of the plate; the rolling motion is obtained by electric current flowing between two electrodes near the edge of the plate and in generally opposite locations; and the rolling motion is rotated by means of a segmented ring electrode near the circumference of the plate in which pairs of opposing segments are used as electrode pairs and neighboring pairs of electrodes are powered sequentially.

Although the description above contains many specificities, these should not be construed as limiting the scope of the invention but as merely providing illustrations of some of the presently preferred embodiments of this invention. Thus the scope of this invention should be determined by the appended claims and their legal equivalents.

What is claimed is:

1. A method for uniformly heating or cooling a plate, comprising the steps of mediating homogeneous heat transfer between the plate and a heating or cooling source through an electrically and thermally conductive fluid forced into convection using Lorentz forces, said forced convection including azimuthal motion associated with a rotational orientation of the fluid generally perpendicular to the plate, rolling motion associated with a rotational orientation of the fluid generally parallel to the plate, and rotation of the rotational orientation associated with the rolling motion over all angles with respect to an axis generally perpendicular to the plate.

2. An apparatus for uniformly heating or cooling a plate according to the method of claim 1, comprising:

(a) a housing, said housing including said plate;

(b) said fluid contained within said housing;

(c) heat transfer means for transferring heat through said fluid;

(d) means for generating azimuthal motion of said fluid associated with a rotational orientation of said fluid generally perpendicular to said plate;

(e) means for generating rolling motion of said fluid associated with a rotational orientation of said fluid generally parallel to said plate; and (f) means for rotating the rotational orientation associated with said rolling motion around an axis generally perpendicular to said plate.

3. An apparatus for uniformly heating or cooling a plate according to the method of claim 1, comprising:

(a) a housing, said housing including said plate;

(b) said fluid contained within said housing;

(c) heat transfer means for transferring heat through said fluid;

(d) means for generating a magnetic field oriented generally perpendicular to the plate;

(e) means for passing electric current between a first electrode and a second electrode, said second electrode having a plurality of segments, said first and second electrodes positioned concentric with said plate, said first electrode positioned in proximity to said plate, said second electrode positioned in proximity to the edge of the plate;

(f) means for passing electric current between opposing segments in said second electrode; and (g) means for sequentially powering adjacent pairs of opposing segments in said second electrode.

4. A uniform heat transfer apparatus, comprising:

(a) a housing, said housing including a heat transfer surface;

(b) an electrically and thermally conducting fluid contained within said housing;

(c) heat transfer means for transferring heat through said fluid;

(d) means for generating azimuthal motion of said fluid associated with a rotational orientation of said fluid generally perpendicular to said heat transfer surface;

(e) means for generating rolling motion of said fluid associated with a rotational orientation of said fluid generally parallel to said heat transfer surface; and (f) means for rotating the rotational orientation associated with said rolling motion around an axis generally perpendicular to the plate.

5. A uniform heat transfer apparatus, comprising:

(a) upper and lower spaced-apart plates, said lower plate including a centrally positioned electrode;

(b) a rim extending circumferentially around said plates, said rim including an upper inner surface and a lower inner surface, said rim and said plates defining an enclosed chamber;

(c) an electrically and thermally conducting fluid contained within said chamber;

(d) a plurality of opposing segmented ring electrodes positioned circumferentially around said upper plate and adjacent to said upper inner surface of said rim;

(e) means positioned adjacent to said lower plate for inducing a magnetic field within said chamber; and (f) heat transfer means for transferring heat between said lower plate and said fluid.

6. An apparatus as recited in claim 5, further comprising a continuous ring electrode positioned circumferentially around said lower plate and adjacent to said lower inner surface of said rim.

7. An apparatus as recited in claim 5, further comprising a power supply electrically coupled to said segmented ring electrodes and said center electrode.

8. An apparatus as recited in claim 5, further comprising a power supply, said power supply including a first source of power, said first source of power electrically coupled to said upper plate and said center electrode, said power supply including a second source of power, said second source of power electrically coupled to said segmented ring electrodes, said first and second sources of power being electrically isolated.

9. An apparatus as recited in claim 6, further comprising a power supply, said power supply including a first source of power, said first source of power electrically coupled to said continuous ring and center electrodes, said power supply including a second source of power, said second source of power electrically coupled to said segmented ring electrodes, said first and second sources of power being electrically isolated.

10. A method of uniformly transferring heat between said upper and lower plates of said apparatus according to claim 5, comprising the steps of:

(a) passing electric current between opposing segmented ring electrodes sequentially among adjacent pairs of said electrodes; and (b) alternating between passing electric current between said segmented ring electrodes and passing electric current between said upper plate and said center electrode.

11. A method of uniformly transferring heat between said upper and lower plates of said apparatus according to claim 5, comprising the step of alternating between passing electric current between opposing segmented ring electrodes sequentially among adjacent pairs of said electrodes and simultaneously passing electric current between each of said segmented ring electrodes and said center electrode.

12. A method of uniformly transferring heat between said upper and lower plates of said apparatus according to claim 5, comprising the step of passing electric current between opposing segmented ring electrodes sequentially among adjacent pairs of said electrodes while maintaining a non-zero mean potential difference between said segmented ring electrodes and said center electrode.

13. A method of uniformly transferring heat between said upper and lower plates of said apparatus according to claim 6, comprising the steps of:

(a) passing electric current between opposing segmented ring electrodes sequentially among adjacent pairs of said electrodes; and (b) passing electric current between said continuous ring and center electrodes.

14. A method as recited in claim 13, further comprising the step of alternating between passing electric current between said segmented ring electrodes and passing electric current between said continuous ring and center electrodes.

15. A uniform heat transfer apparatus, comprising:

(a) upper and lower spaced-apart plates, said lower plate including a centrally positioned electrode;

(b) a rim extending circumferentially around said plates, said rim including an upper inner surface and a lower inner surface, said rim and said plates defining an enclosed chamber;

(c) an electrically and thermally conducting fluid contained within said chamber;

(d) a plurality of opposing segmented ring electrodes positioned circumferentially around said lower plate and adjacent to said lower inner surface of said rim;

(e) means positioned adjacent to said lower plate for inducing a magnetic field within said chamber; and (f) heat transfer means for transferring heat between said lower plate and said fluid.

16. An apparatus as recited in claim 15, further comprising a continuous ring electrode positioned circumferentially around said upper plate and adjacent to said upper inner surface of said rim.

17. An apparatus as recited in claim 15, further comprising a power supply electrically coupled to said segmented ring electrodes and said center electrode.

18. An apparatus as recited in claim 16, further comprising a power supply, said power supply including a first source of power, said first source of power electrically coupled to said continuous ring and center electrodes, said power supply including a second source of power, said second source of power electrically coupled to said segmented ring electrodes, said first and second sources of power being electrically isolated.

19. A method of uniformly transferring heat between said upper and lower plates of said apparatus according to claim 15, comprising the step of alternating between passing electric current between opposing segmented ring electrodes sequentially among adjacent pairs of said electrodes and simultaneously passing electric current between each of said segmented ring electrodes and said center electrode.

20. A method of uniformly transferring heat between said upper and lower plates of said apparatus according to claim 15, comprising the step of passing electric current between opposing segmented ring electrodes sequentially among adjacent pairs of said electrodes while maintaining a non-zero mean potential difference between said segmented ring electrodes and said center electrode.

21. A method of uniformly transferring heat between said upper and lower plates of said apparatus according to claim 16, comprising the steps of:

(a) passing electric current between opposing segmented ring electrodes sequentially among adjacent pairs of said electrodes; and (b) passing electric current between said continuous ring and center electrodes.

22. A method as recited in claim 21, further comprising the step of alternating between passing electric current between said segmented ring electrodes and passing electric current between said continuous ring and center electrodes.

23. An apparatus for uniform transfer of heat, comprising:

(a) an enclosed chamber, said chamber including an upper wall and a lower wall, said lower wall including a centrally positioned electrode, said chamber including a rim, said rim including an upper inner surface and a lower inner surface;

(b) an electrically and thermally conducting fluid contained within said chamber;

(c) a plurality of opposing segmented ring electrodes positioned circumferentially around said upper inner surface of said rim;

(d) means positioned adjacent to said lower wall of said chamber for inducing a magnetic field within said chamber;

(e) heat transfer means for transferring heat between said lower wall and said fluid; and (f) power supply means for providing electric current to said electrodes.

24. An apparatus as recited in claim 23, further comprising a continuous ring electrode positioned circumferentially around said lower inner surface of said rim.

25. An apparatus as recited in claim 23, wherein said power supply means comprises a first source of power, said first source of power electrically coupled to said continuous ring and central electrodes, and a second source of power, said second source of power electrically coupled to said segmented ring electrodes, said first and second sources of power being electrically isolated.

26. A method of uniformly transferring heat between said upper and lower walls of said apparatus according to claim 23, comprising the step of alternating between passing electric current between opposing segmented ring electrodes sequentially among adjacent pairs of said electrodes and simultaneously passing electric current between each of said segmented ring electrodes and said center electrode.

27. A method of uniformly transferring heat between said upper and lower walls of said apparatus according to claim 23, comprising the step of passing electric current between opposing segmented ring electrodes sequentially among adjacent pairs of said electrodes while maintaining a non-zero mean potential difference between said segmented ring electrodes and said center electrode.

28. A method of uniformly transferring heat between said upper and lower walls of said apparatus according to claim 24, comprising the steps of:

(a) passing electric current between opposing segmented ring electrodes sequentially among adjacent pairs of said electrodes; and (b) passing electric current between said continuous ring and center electrodes.

29. A method as recited in claim 28, further comprising the step of alternating between passing electric current between said segmented ring electrodes and passing electric current between said continuous ring and center electrodes.

30. An apparatus for uniform transfer of heat, comprising:

(a) an enclosed chamber, said chamber including an upper wall and a lower wall, said lower wall including a centrally positioned electrode, said chamber including a rim, said rim including an upper inner surface and a lower inner surface;

(b) an electrically and thermally conducting fluid contained within said chamber;

(c) a plurality of opposing segmented ring electrodes positioned circumferentially around said lower inner surface of said rim;

(d) means positioned adjacent to said lower wall of said chamber for inducing a magnetic field within said chamber;

(e) heat transfer means for transferring heat between said lower wall and said fluid; and (f) power supply means for providing electric current to said electrodes.

31. An apparatus as recited in claim 30, further comprising a continuous ring electrode positioned circumferentially around said upper inner surface of said rim.

32. An apparatus as recited in claim 31, wherein said power supply means comprises a first source of power, said first source of power electrically coupled to said continuous ring and central electrodes, and a second source of power, said second source of power electrically coupled to said segmented ring electrodes, said first and second sources of power being electrically isolated.

33. A method of uniformly transferring heat between said upper and lower walls of said apparatus according to claim 30, comprising the step of alternating between passing electric current between opposing segmented ring electrodes sequentially among adjacent pairs of said electrodes and simultaneously passing electric current between each of said segmented ring electrodes and said center electrode.

34. A method of uniformly transferring heat between said upper and lower walls of said apparatus according to claim 30, comprising the step of passing electric current between opposing segmented ring electrodes sequentially among adjacent pairs of said electrodes while maintaining a non-zero mean potential difference between said segmented ring electrodes and said center electrode.

35. A method of uniformly transferring heat between said upper and lower walls of said apparatus according to claim 31, comprising the steps of:

(a) passing electric current between opposing segmented ring electrodes sequentially among adjacent pairs of said electrodes; and (b) passing electric current between said continuous ring and center electrodes.

36. A method as recited in claim 35, further comprising the step of alternating between passing electric current between said segmented ring electrodes and passing electric current between said continuous ring and center electrodes.

37. A apparatus for uniform transfer of heat, comprising:

(a) generally parallel spaced-apart upper and lower plates, said upper and lower plates axially aligned about a central axis, said central axis extending between said plates in a generally perpendicular orientation;

(b) a rim extending circumferentially around said upper and lower plates, said rim including an upper inner surface and a lower inner surface, said rim and said upper and lower plates defining an enclosed chamber;

(c) an electrically and thermally conducting fluid contained within said chamber;

(d) a center electrode, said center electrode axially aligned with said central axis and positioned adjacent to said lower plate;

(e) a plurality of opposing segmented ring electrodes positioned circumferentially around said upper plate and adjacent to said upper inner surface of said rim;

(f) magnetic induction means for producing a magnetic field in said chamber axially aligned with said central axis extending between said upper and lower plates;

(g) heat transfer means for transferring heat between said lower plate and said fluid; and (h) power supply means for providing electric current to said electrodes.

38. An apparatus as recited in claim 37, further comprising a continuous ring electrode, said continuous ring electrode positioned circumferentially around said lower plate and adjacent to said lower inner surface of said rim, said continuous ring electrode axially aligned with said center electrode and said lower plate;

39. An apparatus as recited in claim 37, wherein said magnetic induction means comprises a permanent magnet positioned adjacent to said lower plate.

40. An apparatus as recited in claim 37, wherein said magnetic induction means comprises a plurality of concentric electrically resistive wires positioned adjacent to said lower plate.

41. An apparatus as recited in claim 37, wherein said power supply means comprises a first source of power, said first source of power electrically coupled to said continuous ring and central electrodes, and a second source of power, said second source of power electrically coupled to said segmented ring electrodes, said first and second sources of power being electrically isolated.

42. A method of uniformly transferring heat between said upper and lower plates of said apparatus according to claim 37, comprising the step of alternating between passing electric current between opposing segmented ring electrodes sequentially among adjacent pairs of said electrodes and simultaneously passing electric current between each of said segmented ring electrodes and said center electrode.

43. A method of uniformly transferring heat between said upper and lower plates of said apparatus according to claim 37, comprising the step of passing electric current between opposing segmented ring electrodes sequentially among adjacent pairs of said electrodes while maintaining a non-zero mean potential difference between said segmented ring electrodes and said center electrode.

44. A method of uniformly transferring heat between said upper and lower plates of said apparatus according to claim 38, comprising the steps of:

(a) passing electric current between opposing segmented ring electrodes sequentially among adjacent pairs of said electrodes; and (b) passing electric current between said continuous ring and center electrodes.

45. A method as recited in claim 44, further comprising the step of alternating between passing electric current between said segmented ring electrodes and passing electric current between said continuous ring and center electrodes.

46. An apparatus for uniform transfer of heat, comprising:

(a) generally parallel spaced-apart upper and lower plates, said upper and lower plates axially aligned about a central axis, said central axis extending between said plates in a generally perpendicular orientation;

(b) a rim extending circumferentially around said upper and lower plates, said rim including an upper inner surface and a lower inner surface, said rim and said upper and lower plates defining an enclosed chamber;

(c) an electrically and thermally conducting fluid contained within said chamber;

(d) a center electrode, said center electrode axially aligned with said central axis and positioned adjacent to said lower plate;

(e) a plurality of opposing segmented ring electrodes positioned circumferentially around said lower plate and adjacent to said lower inner surface of said rim;

(f) magnetic induction means for producing a magnetic field in said chamber axially aligned with said central axis extending between said upper and lower plates;

(g) heat transfer means for transferring heat between said lower plate and said fluid; and (h) power supply means for providing electric current to said electrodes.

47. An apparatus as recited in claim 46, further comprising a continuous ring electrode, said continuous ring electrode positioned circumferentially around said upper plate and adjacent to said upper inner surface of said rim, said continuous ring electrode axially aligned with said center electrode and said lower plate.

48. An apparatus as recited in claim 46, wherein said magnetic induction means comprises a permanent magnet positioned adjacent to said lower plate.

49. An apparatus as recited in claim 46, wherein said magnetic induction means comprises a plurality of concentric electrically resistive wires positioned adjacent to said lower plate.

50. An apparatus as recited in claim 47, wherein said power supply means comprises a first source of power, said first source of power electrically coupled to said continuous ring and central electrodes, and a second source of power, said second source of power electrically coupled to said segmented ring electrodes, said first and second sources of power being electrically isolated.

51. A method of uniformly transferring heat between said upper and lower plates of said apparatus according to claim 46, comprising the step of alternating between passing electric current between opposing segmented ring electrodes sequentially among adjacent pairs of said electrodes and simultaneously passing electric current between each of said segmented ring electrodes and said center electrode.

52. A method of uniformly transferring heat between said upper and lower plates of said apparatus according to claim 46, comprising the step of passing electric current between opposing segmented ring electrodes sequentially among adjacent pairs of said electrodes while maintaining a non-zero mean potential difference between said segmented ring electrodes and said center electrode.

53. A method of uniformly transferring heat between said upper and lower plates of said apparatus according to claim 47, comprising the steps of:

(a) passing electric current between opposing segmented ring electrodes sequentially among adjacent pairs of said electrodes; and (b) passing electric current between said continuous ring and center electrodes.

54. A method as recited in claim 53, further comprising the step of alternating between passing electric current between said segmented ring electrodes and passing electric current between said continuous ring and center electrodes.

* * * * *